US007137312B2

(12) United States Patent
Cole

(10) Patent No.: US 7,137,312 B2
(45) Date of Patent: Nov. 21, 2006

(54) GEAR WHEELS ROLL FORMED FROM POWDER METAL BLANKS

(75) Inventor: Christopher John Cole, Tewkesbury (GB)

(73) Assignee: FormFlo Limited, Gloucestershire (GB)

( * ) Notice: Subject to any disclaimer, the term of this patent is extended or adjusted under 35 U.S.C. 154(b) by 453 days.

(21) Appl. No.: 10/240,447

(22) PCT Filed: Mar. 30, 2001

(86) PCT No.: PCT/GB01/01477

§ 371 (c)(1),
(2), (4) Date: Jul. 14, 2003

(87) PCT Pub. No.: WO01/74514

PCT Pub. Date: Oct. 11, 2001

(65) Prior Publication Data

US 2004/0221453 A1 Nov. 11, 2004

(30) Foreign Application Priority Data

Mar. 30, 2000 (GB) ..... 0007819.6

(51) Int. Cl.
*F16H 55/06* (2006.01)

(52) U.S. Cl. ..... 74/462; 74/457; 428/547

(58) Field of Classification Search ..... 74/462, 74/457; 428/547

See application file for complete search history.

(56) References Cited

U.S. PATENT DOCUMENTS

| | | | | |
|---|---|---|---|---|
| 2,561,735 | A | | 7/1951 | Haller |
| 3,020,589 | A | | 2/1962 | Maritano |
| 3,394,432 | A | | 7/1968 | Laurent |
| 3,694,127 | A | | 9/1972 | Takahashi et al. |
| 3,752,622 | A | | 8/1973 | Viadana |
| 3,773,446 | A | | 11/1973 | Borrini |
| 3,842,646 | A | | 10/1974 | Kuhn |
| 3,891,367 | A | | 6/1975 | Signora |
| 3,909,167 | A | | 9/1975 | Signora |
| 4,008,021 | A | | 2/1977 | Fedrigo et al. |
| 4,043,385 | A | | 8/1977 | Petrenchik |
| 4,047,864 | A | | 9/1977 | DeSantis |
| 4,053,267 | A | | 10/1977 | DeSantis |
| 4,061,452 | A | | 12/1977 | DeSantis |
| 4,061,453 | A | | 12/1977 | DeSantis |
| 4,087,221 | A | | 5/1978 | Munson et al. |
| 4,153,399 | A | | 5/1979 | DeSantis |
| 4,270,890 | A | | 6/1981 | Öttl |
| 4,401,614 | A | | 8/1983 | DeSantis |
| 4,482,307 | A | | 11/1984 | Schaidl et al. |
| 4,573,895 | A | | 3/1986 | DeSantis et al. |
| 4,666,389 | A | | 5/1987 | Relis et al. |
| 4,708,912 | A | * | 11/1987 | Huppmann ..... 428/547 |
| 4,853,180 | A | | 8/1989 | Howard |

(Continued)

FOREIGN PATENT DOCUMENTS

| | | | |
|---|---|---|---|
| DE | 3140189 | A1 | 10/1981 |

(Continued)

*Primary Examiner*—David M. Fenstermacher
(74) *Attorney, Agent, or Firm*—Levenfeld Pearlstein, LLC

(57) ABSTRACT

A method is disclosed for the manufacture of gear wheels having two axially adjacent gears (4,6) thereon. A blank is prepared with the two gears crudely formed thereon by compressing and sintering a shaped mass of substantially metal powder. The blank is then mounted for rotation about a first axis, and the gears are roll-formed on the blank by rotating the blank in meshing engagement with respective dies (10,12) mounted for rotation about second and third axes substantially parallel to the first axis.

12 Claims, 2 Drawing Sheets

U.S. PATENT DOCUMENTS

| | | | | |
|---|---|---|---|---|
| 4,923,382 | A | 5/1990 | Klein | |
| 5,024,811 | A | 6/1991 | Himzmann et al. | |
| 5,043,111 | A | 8/1991 | Himzmann et al. | |
| 5,043,123 | A | 8/1991 | Gormanns et al. | |
| 5,049,054 | A | 9/1991 | Schaidl et al. | |
| 5,156,854 | A | 10/1992 | Yamada | |
| 5,238,375 | A | 8/1993 | Hirai | |
| 5,259,744 | A | 11/1993 | Take | |
| 5,326,242 | A | 7/1994 | Katagiri et al. | |
| 5,366,363 | A | 11/1994 | Good et al. | |
| 5,401,153 | A | 3/1995 | Katagiri et al. | |
| 5,478,225 | A | 12/1995 | Takeuchi et al. | |
| 5,498,147 | A | 3/1996 | Katagiri et al. | |
| 5,659,955 | A | 8/1997 | Plamper | |
| 5,698,149 | A | 12/1997 | Hinzmann et al. | |
| 5,711,187 | A * | 1/1998 | Cole et al. | 74/434 |
| 5,884,527 | A * | 3/1999 | Cole et al. | 74/434 |
| 6,151,778 | A * | 11/2000 | Woolf et al. | 29/893.32 |
| 6,401,562 | B1 * | 6/2002 | De' Stefani | 74/462 |
| 2004/0016123 | A1 * | 1/2004 | Sandner | 29/893 |

FOREIGN PATENT DOCUMENTS

| | | |
|---|---|---|
| EP | 0 552 272 B1 | 7/1994 |
| EP | 09276967 | 10/1997 |
| EP | 0 925 857 A2 | 6/1999 |
| GB | 2 138 723 A | 10/1984 |
| GB | 2143161 | 2/1985 |
| GB | 2250227 | 6/1992 |
| GB | 2313334 | 11/1997 |
| JP | 9-276967 | 10/1997 |
| WO | 97/46067 | 11/1997 |

* cited by examiner

GEAR WHEELS ROLL FORMED FROM POWDER METAL BLANKS

This invention relates to gear wheels, and particularly the roll forming of gear wheels from powder metal blanks. It has particular application to wheels for use in gear boxes for motor vehicles, including passenger cars and motor cycles.

Gear Wheels have conventionally been formed from steel castings, with spur or helical gear teeth being cut thereon. Gear wheels formed from powder metal blanks had been proposed, but only in relatively low duty applications. However, and as described in our European Patent No. 0 552 272, to which reference is directed, it has recently been made possible to use gears formed from powder metal blanks for heavier duty.

The present invention is concerned particularly with the manufacture of gear wheels having two axially adjacent gears formed thereon, although it also applicable to wheels having more than two adjacent gears. Specifically, we have found that it is possible to create adjacent gears on the same unitary powder metal hub, using roll-forming techniques. In a method according to the invention, a blank is prepared with the two gears crudely formed thereon by compressing and sintering a shaped mass of substantially metal powder. The blank is then mounted for rotation about a first axis, and the gears are roll-formed on the blank by rotating the blank in meshing engagement with respective dies mounted for rotation about second and third axes substantially parallel to the first axis. This manufacturing method can of course be controlled in accordance with criteria specific to the blank, and to the gears to be formed thereon. Thus, while the engagement of the dies with the blank will normally be simultaneous during at least a portion of the roll-forming process, this is not essential to the method.

In the roll forming stage of methods according to the invention, a preferred technique is that disclosed in our European Patent No. 0 552 272, referred to above. Thus, the tooth, root and flank regions of gears formed on the powder metal blank are typically surfaced hardened to establish densification in the range of 90 to 100 percent to a depth of at least 380 microns. The core density; ie below the densified regions, is usually substantially uniform, typically at around 90 percent. Normally the depth of densification is in the range 380 to 500 microns. We have found that little additional benefit is achieved if the depth of densification exceeds 1000 microns. The density at the surface is substantially 100%, and remains at a density no less than 90% at least to the minimum depth specified. The rate at which the density reduces with respect to depth is normally at least linear; ie, the minimum density in the hardened regions is directly inversely proportional to the depth. Usually, the density at least in regions closer to the surface will be significantly greater than this minimum value. Typically, the rate of density reduction will be very low at the surface and increase uniformly towards the maximum depth of the hardened regions. Thus the density might vary in relation to the square or a higher power of the depth.

The metal powders used in gears according to the invention will be selected according to the eventual application, and can include low alloy steel grades similar to those used in the manufacture of high performance gears from other forms of metal. The powders can be either admixed elemental iron plus alloying additions, or fully pre-alloyed powders. Typical fully pre-alloyed powders would be of a composition such as AISI 4600 and its derivatives. Admixed powders have the advantage of being more compressible, enabling higher densities to be reached at the compaction stage. In addition, the use of admixed powders enables compositions to be tailored to specific applications. For example, elemental powders may be blended together with a lubricant to produce, on sintering, low alloy gears of compositions similar to SAE 4100, SAE 4600, and SAE 8600 grades. Elemental powder additions to the base iron can include Carbon, Chromium, Molybdenum, Manganese, Nickel, Copper, and Vanadium. Again, quantities of the additives will vary with different applications, but will normally be no more than 5 percent by weight in each case. A preferred admixed powder composition in gears according to the invention has the following composition by weight:

| | |
|---|---|
| Carbon | 0.2% |
| chromium | 0.5% |
| Manganese | 0.5% |
| Molybdenum | 0.5% |

the balance being iron and unavoidable impurities.

It will be recognised that the use of Chromium, Molybdenum and Manganese in the formation of a sintered powder metal blank requires a sintering process which can minimise their oxidation. A preferred process used in this invention is to sinter at high temperature up to 1350* C. in a very dry Hydrogen/Nitrogen atmosphere, for example at a dew point of around −40* C. This has the additional benefit of further improving mechanical properties and reducing oxygen levels to approximately 200 ppm. The alloying addition powders used in gears according to the invention will preferably have a particle size in the range 2 to 10 microns. Generally, particle sizes in this range can be achieved by fine grinding of ferroalloys in an appropriate inert atmosphere. Prevention of oxidation of readily oxidisable alloying powders at the grinding stage can be critical to the achievement of the degrees of densification referred to above.

Gear wheels of the kind to which this invention primarily relates will of course normally have different gears formed thereon; i.e. gears having different diameters and/or different numbers of teeth. Commonly, one of the gears will be a helical gear and the other a spur gear, with the diameter of the helical gear normally being greater than that of the spur gear.

Prior to the present invention, wheels with two axially adjacent gears formed thereon were manufactured in two separate components, with one gear being cut on a unitary body including the wheel hub, with the other being cut on a separate annulus subsequently fitted on the hub, typically by a shrink fit. It will be appreciated that it is not possible to cut axially adjacent gears of different sizes on the same unitary body. However, we have found that not only is it possible to roll-form such gears on a unitary body, it is also possible to do so with the axial spacing between the gears being reduced relative to what was previously possible. Specifically, with a roll-formed wheel according to the invention, there is no need for an annular slot between the gears.

The invention will now be described by way of example, and with reference to the accompanying schematic drawings, wherein.

Figure 1:
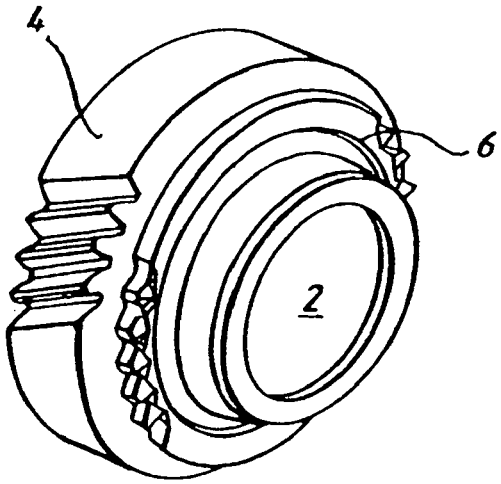
FIG. 1 is a perspective view of a gear wheel embodying the invention.
Figure 2:
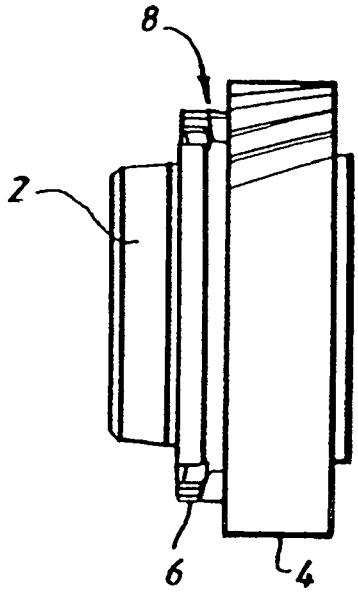
FIG. 2 is a side view of the gear wheel of FIG. 1.

The wheel shown in FIG. 1 is a unitary body formed in powder metal. It consists of a hub 2, upon which are roll-formed a helical gear 4 and a spur gear 6. As can be seen, the diameter of the helical gear is larger than that of the spur gear, and there is formed between the two gears an annular slot 8.

Figure 3:
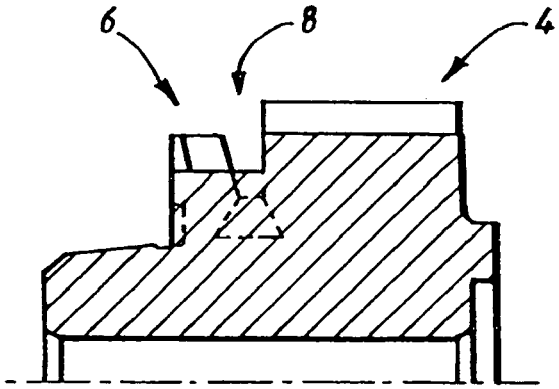
FIG. 3 is an enlarged sectional view showing details of teeth on the adjacent gears in the wheel of FIGS. 1 and 2.
Figure 4:
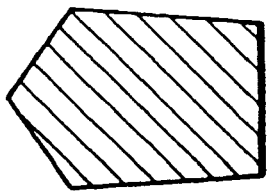
FIG. 4 is a plan view of a spur tooth shown in FIG. 3.

FIGS. 3 and 4 show some details of the teeth on a gear wheel according to the invention, and particularly illustrate the annular slot 8 between the two gears. This is shown in order to demonstrate how gear wheels according to the invention can duplicate existing wheels. However, it will be appreciated that with both gears being roll-formed on the unitary blank the axial extent of the slot can be greatly reduced, if not totally eliminated.

A further advantage of roll-forming particularly the spur gear in the embodiment described is the ability to create a reverse axial taper on the teeth. This is shown in FIG. 4, and it will be appreciated that achieving any kind of reverse taper of this kind on a gear tooth cut by conventional means would be an extremely laborious process, certainly unsuitable to mass production techniques.

Figure 5:
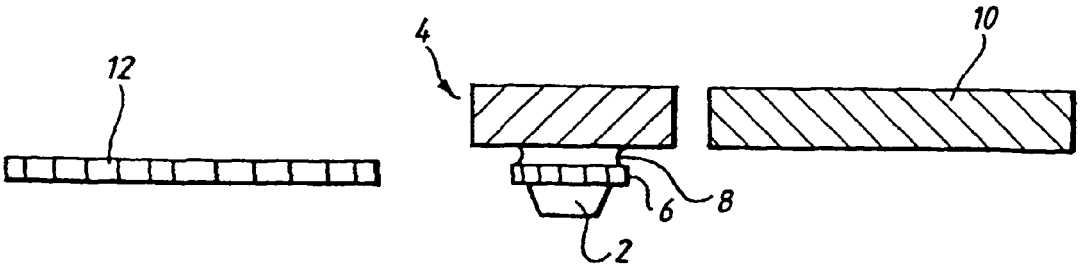
FIG. 5 shows the arrangement of the wheel blank and the roll forming dyes at the commencement of a method according to the invention.
Figure 6:
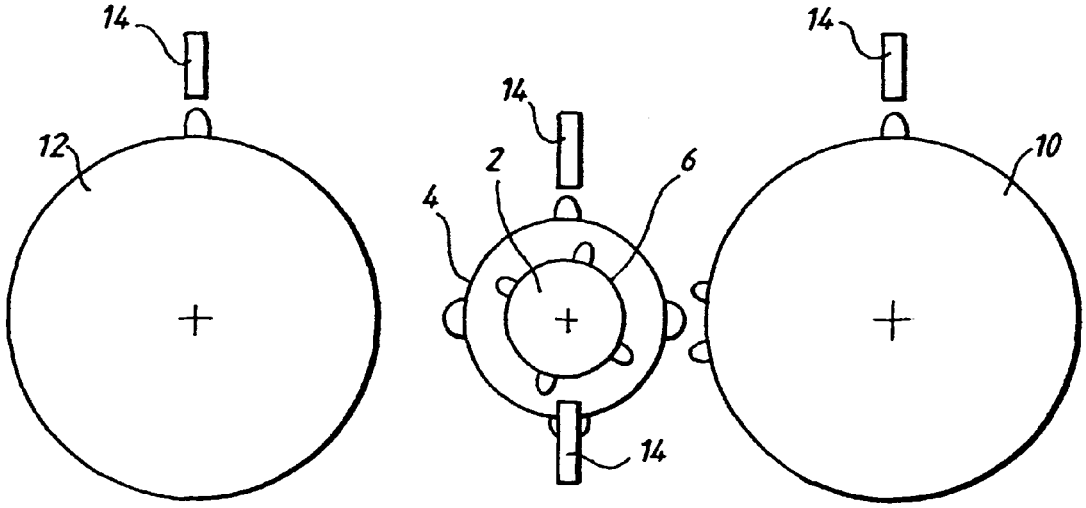
FIG. 6 is an axial end view of the arrangement of FIG. 4.
Figure 7:
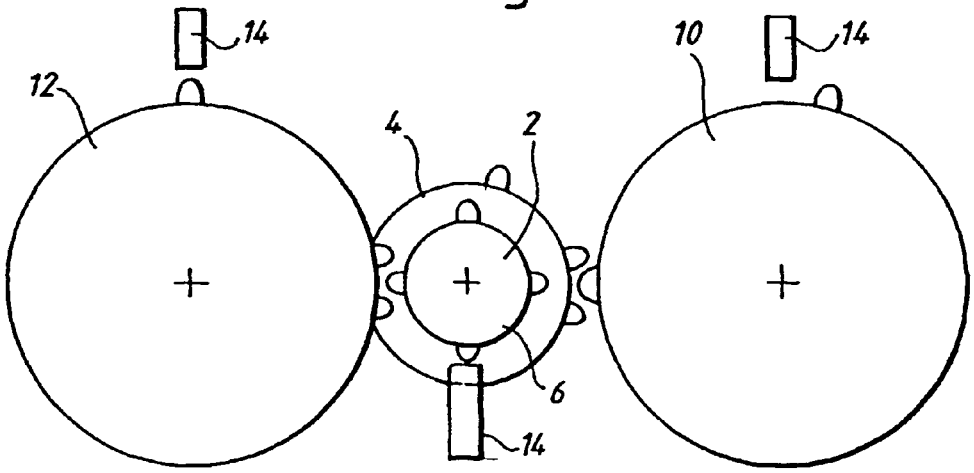
FIG. 7 shows the dyes of FIGS. 4 and 5 in machine engagement with the gear wheel blank during the rolling process.

FIG. 5 shows the relative positions of the gear wheel blank and two rolling dies 10,12 in a rolling machine adapted to exploit the invention, and FIGS. 6 and 7 show end views of this arrangement. As the method is carried out, the blank is axially clamped on a shaft, and it should be noted that in processes of the invention with the simultaneous engagement of the roll forming dies with the axially displaced gears, a turning force or moment will be created acting on the blank about an axis perpendicular to the blank axis. Apart from some additional clamping of this kind, the method of the present invention can be practised on a rolling machine essentially similar to those already used in the rolling of gears in metal blanks, for example as described and referred to in our European Patent specification No. 0 808 679.

FIGS. 6 and 7 show sensors 14 mounted over the periphery of each rolling die, and of each crudely formed gear on the gear wheel blank. The purpose of these sensors is to locate the position of the teeth on the respective element, and ensure that they are appropriately misaligned when the die engages the respective wheel teeth. This facility is particularly important in the method of the present invention, where the respective dies are to make working meshing engagement with two axially spaced gears.

In a method according to the invention, the helical die 10 will normally first be brought into static or backlash mesh with the helical gear which in the embodiment illustrated has the larger diameter of the two gears. The next step is the static or backlash engagement of the other die wheel 12 with the spur gear section of the blank. Once proper meshing engagement has been established, roll-forming can be continued broadly in the manner described in our prior patent specifications referred to above.

The invention claimed is:

1. A method of manufacturing a wheel having two different and distinct axially adjacent gears formed thereon, which method comprises:

a) preparing a blank with the gears crudely formed thereon by compressing and sintering a shaped mass of substantially metal power;

b) mounting the blank for rotation about a first axis, and c) roll forming the gears on the blank by rotating the blank in meshing engagement with respective dies mounted for rotation about second and third axes substantially parallel to the first axis.

2. A method according to claim 1 wherein the engagement of the dies with the blank is controlled in accordance with criteria specific to the blank and the gears to be formed thereon.

3. A method according to claim 1 or claim 2 wherein the engagement of the dies with the blank is simultaneous during at least a portion of the roll forming process.

4. A method according to any preceding claim wherein second and third axes are on opposite sides of the first axis.

5. A method according to any preceding claim wherein each die is advanced into loose mesh with its respective gear form prior to commencement of the roll forming process.

6. A method according to claim 5 where each die is advanced separately into loose mesh with its respective gear form.

7. A method according to any preceding claim wherein one of the gears is a helical gear and the other a spur gear.

8. A method according to claim 7 wherein the helical gear has a greater number of teeth than the spur gear.

9. A method according to claim 8 where the crest diameter of the spur gear is greater than the root diameter of the helical gear.

10. A gear wheel having two axially adjacent gears formed thereon wherein the wheel is a unitary body consisting of a compressed and sintered mass of substantially metal powder, with both gears roll formed thereon.

11. A gear wheel according to claim 10 wherein the crest diameters of the gears are different.

12. A gear wheel according to claim 11 wherein the gear having the larger crest diameter is a helical gear, and the gear having the smaller crest diameter is a spur gear.

* * * * *